US006508386B2

(12) United States Patent
Magri

(10) Patent No.: US 6,508,386 B2
(45) Date of Patent: Jan. 21, 2003

(54) HIGH PRESSURE HYDRAULIC CLEANING UNIT POSSIBLY WITH DETERGENT EJECTOR DEVICE

(75) Inventor: Maurizio Magri, Modena (IT)

(73) Assignee: Annovi Reyerberi S.p.A., Modena (IT)

( * ) Notice: Subject to any disclaimer, the term of this patent is extended or adjusted under 35 U.S.C. 154(b) by 0 days.

(21) Appl. No.: 09/901,669

(22) Filed: Jul. 11, 2001

(65) Prior Publication Data

US 2002/0008162 A1 Jan. 24, 2002

(30) Foreign Application Priority Data

Jul. 20, 2000 (IT) ..... RE000024 U

(51) Int. Cl.[7] ..... B67D 5/60

(52) U.S. Cl. ..... 222/145.5; 222/518; 222/637; 239/318

(58) Field of Search ..... 222/518, 145.5, 222/145.6, 637; 251/149.1; 239/318

(56) References Cited

U.S. PATENT DOCUMENTS

| | | | | | |
|---|---|---|---|---|---|
| 4,277,030 | A | * | 7/1981 | Hechler, IV | 239/407 |
| 4,790,376 | A | * | 12/1988 | Weeks | 166/68 |
| 4,951,877 | A | * | 8/1990 | Arsi | 239/240 |
| 5,613,773 | A | * | 3/1997 | Scott et al. | 366/163.2 |
| 5,879,548 | A | * | 3/1999 | Al-Ali | 210/175 |
| 5,915,591 | A | * | 6/1999 | Erickson et al. | 222/1 |
| 6,019,257 | A | * | 2/2000 | Rasmussen | 222/400.7 |
| 6,039,060 | A | * | 3/2000 | Rower | 134/167 R |

* cited by examiner

*Primary Examiner*—Joseph A. Kaufman
(74) *Attorney, Agent, or Firm*—Browdy and Neimark

(57) ABSTRACT

A hydraulic cleaning unit comprising a high pressure pump (1) arranged to feed a service lance via a hose (10), the pump delivery conduit opening to the outside via a stub shaped as the male part of a usual rotatable quick connect coupling.

10 Claims, 2 Drawing Sheets

HIGH PRESSURE HYDRAULIC CLEANING UNIT POSSIBLY WITH DETERGENT EJECTOR DEVICE

BACKGROUND OF THE INVENTION

This invention relates to improvements in high pressure wash pumps with a possible ejector device for detergent or similar products for cleaning surfaces in general, such as food equipment, earth moving machines and motor vehicles.

Hereinafter a detergent product or the like means any auxiliary liquid added to the wash water, such as a descaling, disinfestation, sanitizing or other similar liquids.

As is well known, said hydraulic cleaning units comprise a conveniently motor-driven pump supplying pressurized water to a hydraulic lance provided with a delivery nozzle.

Said nozzle is generally but not necessarily able to operate in two ways, in one of which it delivers a solution of water and detergent at low pressure, and in the other of which it delivers water alone at high pressure.

To mix the water and detergent, which is done automatically, such units are provided with an ejector consisting essentially of a venturi tube which intercepts the passage conduit for the water directed to the lance, and presents a transverse draw-in conduit connected, possibly by way of a suitable valve, to a vessel containing detergent.

In modern hydraulic cleaning units the hose connected to the lance is usually screwed onto a threaded stub integral with the pump delivery conduit comprising the venturi tube.

To facilitate use of the lance, the male part of a quick connect coupling is permanently screwed onto said stub, the female part being applied to the hose.

The result is hence a rotatable quick connect coupling by which said hose can rotate about itself during the handling of the lance.

The aforedescribed known arrangement has proved unsatisfactory for various reasons, including on the one hand its constructional complexity and relative machining costs, and on the other hand its overall size and weight.

In this sector there is consequently a requirement for means able to overcome said problem while still maintaining proper operability of the ejector device, by providing the pump directly with means for receiving the female part of a quick connect coupling, without compromising the mixing of the detergent with the water.

The main object of this invention is to satisfy this requirement within the context of a constructionally simple, rational and reliable solution of low overall size, cost and weight.

Said object is attained by virtue of the characteristics indicated in the claims.

In attaining said object, according to the invention the pump delivery stub is shaped as the male part of a usual rotatable quick connect coupling.

If a detergent ejector is provided, this latter comprises a tubular connection member, described hereinafter, having a first portion with which the venturi tube is associated, and a second portion in the form of a part (typically the male part) of said rotatable quick connect coupling.

Essentially, said tubular member incorporates in one piece both said rotatable coupling part and said venturi tube, which can be integral with the tubular member or not.

By this means all the objects of the invention are attained in that said double-function tubular connection member reduces the number of component elements required for connecting the ejector to the hose, with evident simplification of the assembly and a reduction in cost, overall size and weight, without any compromise in the operability and life of the ejector device.

The constrictional characteristics and merits of the invention will be apparent from the ensuing detailed description given with reference to the figures of the accompanying drawings, which show a hydraulic cleaning unit provided with a detergent ejector.

DETAILED DESCRIPTION OF THE DRAWINGS

Figure 1:
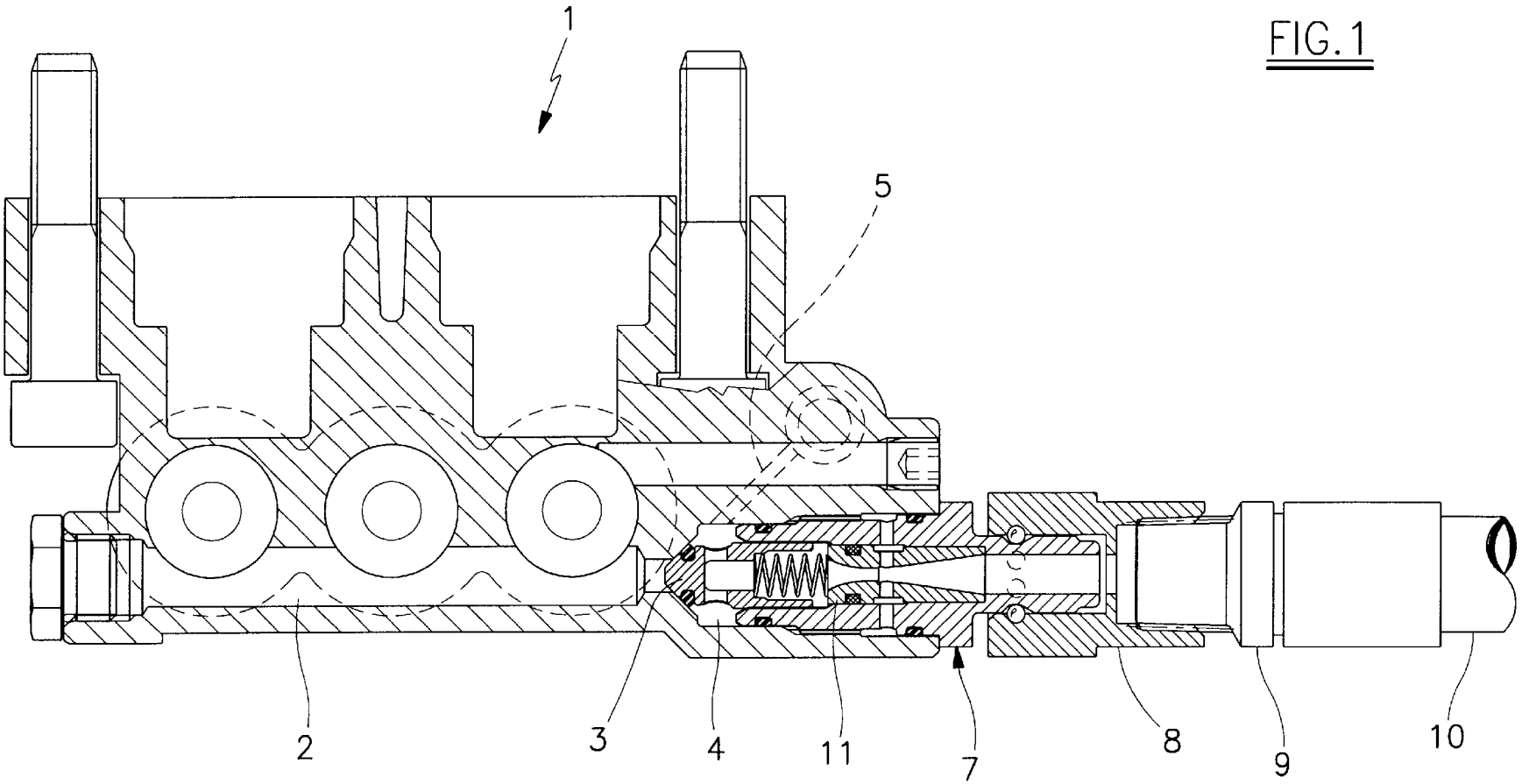
FIG. 1 is an axial section through an ejector according to the invention in its assembled configuration.

Said figures show a pump 1, shown schematically because of known type, its delivery conduit 2 presenting a constriction forming the seal seat for a usual non-return valve 3.

Downstream (with reference to the outflow direction of the cleaning water) of the seal gasket 30 of the non-return valve 3 there is a toroidal chamber 4 from which a conduit 5 extends, leading to a usual pressure regulator valve.

Downstream of said toroidal chamber 4 there are provided a hollow profiled cylindrical member 7 hereinafter also known as the tubular member, the female part 8 of a quick connect coupling, and a usual rear terminal connector 9 of a hose 10 connected to a lance not shown, of known type, provided with a likewise known nozzle (not shown).

Said female part 8 of said quick connect coupling is of known type and is therefore shown schematically.

According to the invention, the male part of said coupling is formed in one piece with the cylindrical member 7, which is screwed into the body of the pump 1 against which it rests via the abutment flange 12.

On the opposite side of said flange 12, said cylindrical member 7 presents a hollow stub 88 forming the male part of the coupling, to be coupled to said female part 8 to form the rotatable quick connect coupling.

As can be seen, the hole passing through the tubular member 7 presents three portions of diameter gradually decreasing from upstream to downstream, of which the first slidingly carries the non-return valve 3 and its closure spring 33, the second contains a venturi tube 11, and the third connects the venturi tube 11 to the downstream elements.

Figure 2:
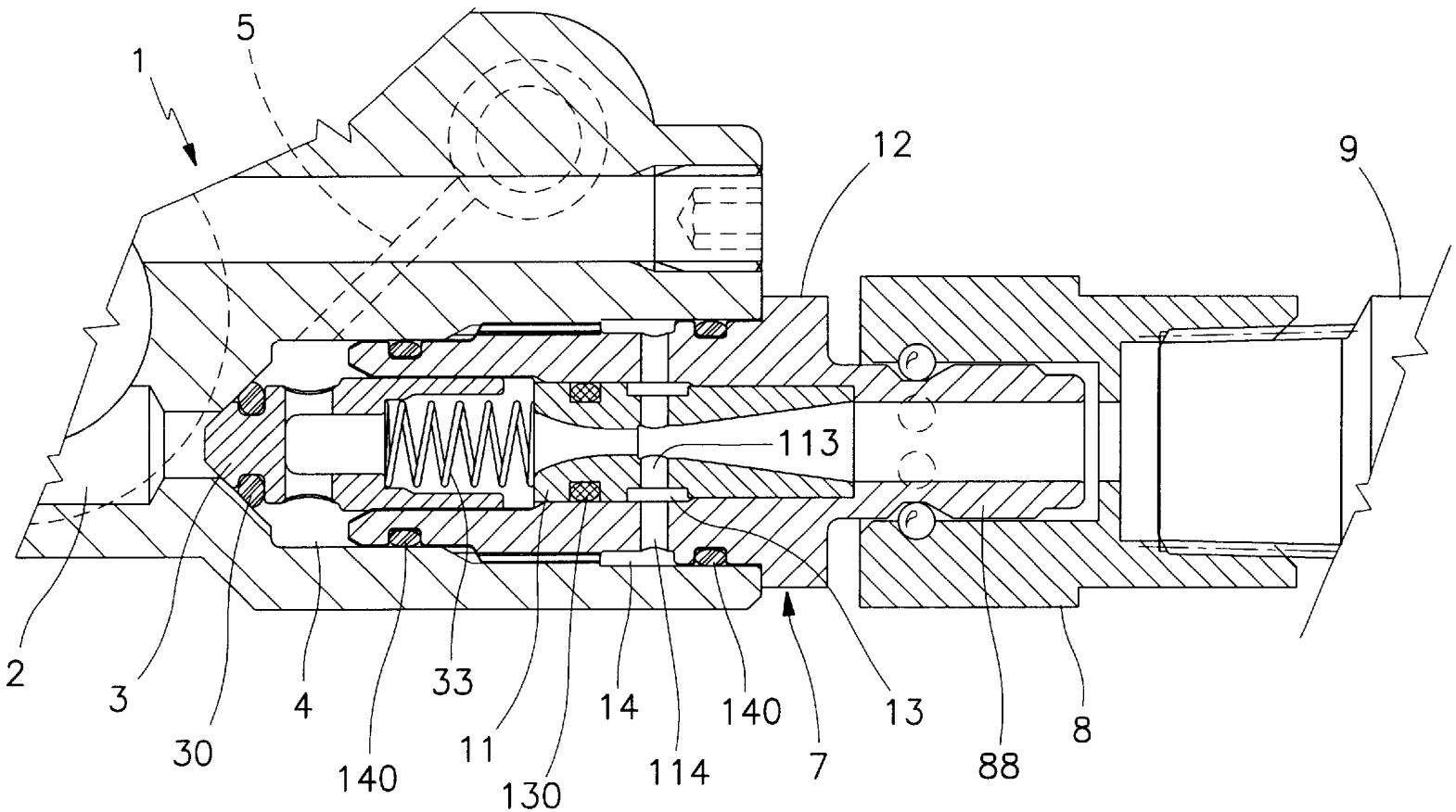
FIG. 2 shows a part of FIG. 1 on an enlarged scale.

In addition, as can be seen from FIG. 2, between the venturi tube 11 and the tubular member 7 there is provided a first annular chamber 13 with which an upstream gasket 130 is associated, between the member 7 and the casing of the pump 1 there being provided a second annular chamber 14 with which two opposing lateral gaskets 140 are associated.

The restriction of the venturi tube 11 communicates with said first annular chamber 13 via a circumferential series of small equidistant radial conduits 113, said first 13 and second 14 annular chamber being connected together by the radial conduits indicated by 114.

Finally, from said second annular chamber 14 there branches a suction conduit, not shown as of known type, which is connected to a vessel containing a liquid detergent, possibly by way of a suitable valve.

The operation of the aforedescribed ejector device is described in the introduction.

The merits and advantages thereof are apparent from the aforegoing and from an examination of the accompanying figures.

I claim:

1. A hydraulic cleaning unit comprising: a high pressure pump having a delivery conduit, said delivery conduit including a chamber; a non-return valve disposed in said delivery conduit; and a hollow profiled cylindrical member sealingly screwed into said chamber and comprising a hollow stub forming a male part of a rotatable quick connect coupling for connecting said pump to a hose for feeding a service lance.

2. The hydraulic cleaning unit of claim 1, further comprising a venturi tube disposed in said hollow cylindrical member, said venturi tube having a narrow section arranged to be in communication with a vessel containing a detergent.

3. The hydraulic cleaning unit of claim 2 wherein said venturi tube is provided within a separate body inserted into said hollow profiled cylindrical member, and said venturi tube comprises a circumferential groove communicating with the narrow section of said venturi tube and disposed between the narrow section and the vessel containing a detergent.

4. The hydraulic cleaning unit of claim 2 wherein said venturi tube is formed in one piece with said hollow profiled cylindrical member.

5. The hydraulic cleaning unit of claim 1 further comprising a female part of the quick connect coupling connected to the hose.

6. A hydraulic cleaning unit comprising: a high pressure pump having a delivery conduit, said delivery conduit including a chamber; a non-return valve disposed in said delivery conduit; a hollow profiled cylindrical member sealingly screwed into said chamber and comprising a hollow stub; and a rotatable quick connect coupling having a male part formed by said stub for connecting said pump to a hose for feeding a service lance.

7. The hydraulic cleaning unit of claim 6, further comprising a venturi tube disposed in said hollow cylindrical member, said venturi tube having a narrow section arranged to be in communication with a vessel containing a detergent.

8. The hydraulic cleaning unit of claim 7 wherein said venturi tube is provided within a separate body inserted into said hollow profiled cylindrical member, and said venturi tube comprises a circumferential groove communicating with the narrow section of said venturi tube and disposed between the narrow section and the vessel containing a detergent.

9. The hydraulic cleaning unit of claim 7 wherein said venturi tube is formed in one piece with said hollow profiled cylindrical member.

10. The hydraulic cleaning unit of claim 6 wherein said quick connect coupling further comprises a female part connected to the hose.

* * * * *

UNITED STATES PATENT AND TRADEMARK OFFICE

CERTIFICATE OF CORRECTION

PATENT NO. : 6,508,386 B2
DATED : January 21, 2003
INVENTOR(S) : Maurizio Magri

It is certified that error appears in the above-identified patent and that said Letters Patent is hereby corrected as shown below:

Title page,
Item [73], Assignee, delete "Reyerberi" and insert therefor -- Reverberi --.

Signed and Sealed this

Fifteenth Day of July, 2003

JAMES E. ROGAN
*Director of the United States Patent and Trademark Office*